United States Patent [19]

Ase

[11] Patent Number: 4,749,170

[45] Date of Patent: Jun. 7, 1988

[54] METHOD OF ARRANGING A SPLICE SLEEVE TO RECEIVE REINFORCING BARS

[75] Inventor: Masaaki Ase, Kukizaki, Japan

[73] Assignee: Splice Sleeve Japan, Ltd., Tokyo, Japan

[21] Appl. No.: 931,256

[22] Filed: Nov. 17, 1986

[51] Int. Cl.[4] ..... B28B 1/16

[52] U.S. Cl. ..... 264/256; 52/259; 52/726; 52/743; 249/93; 403/265; 264/271.1

[58] Field of Search ..... 52/259, 432, 434, 726, 52/743; 249/86, 93; 403/265-267, 248, 249, 227; 264/35, 228, 256, 271.1; 269/229, 236; 220/238; 29/452, 526 R

[56] References Cited

U.S. PATENT DOCUMENTS

| | | | |
|---|---|---|---|
| 2,607,370 | 8/1952 | Anderson | 220/238 X |
| 2,908,303 | 10/1959 | Schmidt | 269/10 |
| 3,159,393 | 12/1964 | Villano | 269/49 |
| 3,337,097 | 8/1967 | Day | 220/238 X |
| 3,540,763 | 11/1970 | Yee | 403/265 |
| 3,613,325 | 10/1971 | Yee | 52/236.8 |
| 3,764,066 | 10/1973 | Kowell | 238/84 |
| 3,833,706 | 9/1974 | Edwards | 264/228 |
| 4,083,468 | 4/1978 | Batchelor | 220/234 |
| 4,159,099 | 6/1979 | Maguire | 249/93 |
| 4,453,488 | 6/1984 | Watchorn | 114/266 |
| 4,478,331 | 10/1984 | Ruin | 206/334 |

FOREIGN PATENT DOCUMENTS

| | | | |
|---|---|---|---|
| 517386 | 1/1931 | Fed. Rep. of Germany | 220/238 |
| 2122129A | 1/1984 | United Kingdom | 249/86 |

*Primary Examiner*—John E. Murtagh
*Assistant Examiner*—Andrew Joseph Rudy
*Attorney, Agent, or Firm*—George B. Oujevolk

[57] ABSTRACT

A method of arranging a splice sleeve to receive a reinforcing bar in a mold for use in manufacturing a precast concrete member by providing an elastic body having a through opening hole generally extending through the longitudinal center of the body, in the interior hollow of the sleeve by inserting an extending bar with a pull-out preventing portion at the end of the bar, into the through hole of the elastic body so as to form the bar projecting from the inside of the mold to the outside of the mold, and by drag pulling the projecting extending bar toward the outside of the mold so as to press the elastic body, thereby to fix the elastic body to the interior wall of the sleeve, and the elastic body being compressed so as to get in close contact with the interior surface of the sleeve, thereby to fix the splice sleeve to the mold.

1 Claim, 4 Drawing Sheets

METHOD OF ARRANGING A SPLICE SLEEVE TO RECEIVE REINFORCING BARS

FIELD OF THE INVENTION

The present invention relates to a method of setting or arranging a splice sleeve to receive reinforcing bars (hereinafter referred to as "splice sleeve") in manufacturing a precast concrete member, and particularly to a method of setting or fixing the splice sleeve into a mold for use in manufacturing a precast concrete member (hereinafter referred to as "mold").

DESCRIPTION OF THE PRIOR ART

There is known, for example, in U.S. Pat. No. 3,613,325 the technique of using a splice sleeve to join reinforcing bars in building a precast concrete construction system where column units, beam units, wall units, and floor slab units are used as a unit of construction and a plurality of combination units are assembled.

The slice sleeve comprises an elongated hollow receiving body having opposed open ends, the interior surface of the hollow body having a plurality of grooves oriented generally traversely of the body. The configuration thereof may be straight tube, or may be in the form of a double frustum having a maximum diameter at a generally central point and tapering outwardly in opposed directions a to relatively smaller diameter at the both ends. For example, U.S. Pat. No. 3,540,763 discloses a splice sleeve adapted to receive adjoining ends of a pair of reinforcing bars by inserting each end of the reinforcing bars through opposed open ends of the sleeve and abutting at a generally central point, wherein fluid grout fills into the interior of the sleeve, and upon solidifying, locks the two ends of a pair of the reinforcing bars therein.

SUMMARY OF THE INVENTION

A primary object of the present invention is to provide a method of easy and surely setting of a splice sleeve into a mold having an embeded splice sleeve into one portion of the precast concrete member and a method of easy removal of the setting.

It is another object of the present invention to provide a method of easy setting a splice sleeve by means of a simple tool into the mold.

It is a further object of the present invention to provide a method of easily setting the splice sleeve by using a simple tool that can be repeatedly applied to the mold.

The foregoing and other objects of the present invention can be attained according to the following detailed description, when taken together with the accompanying drawings, in which;

DETAILED DESCRIPTION OF PREFERRED EMBODIMENTS

Figure 1:
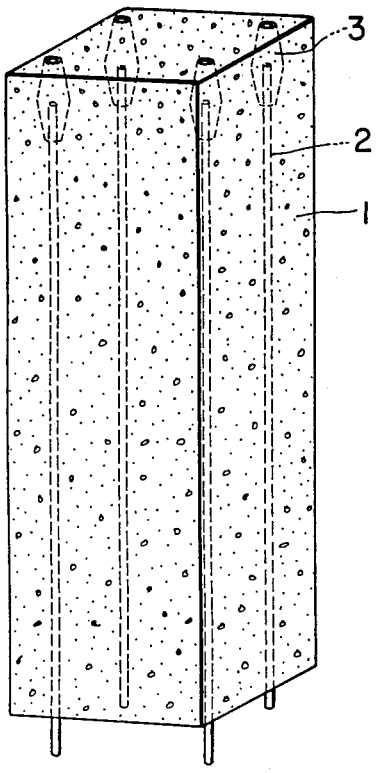
FIG. 1 is a perspective view illustrating a precast concrete member where the splice sleeve and the reinforcing bars within the precast concrete member are shown by dotted lines.

Referring now more specifically to the drawings. FIG. 1 illustrates one example of a column unit 1 of a precast concrete member, wherein splice sleeves 3 are embeded in one end of the precast concrete member in a direction oriented longitudinally of the precast concrete member, and the embeded sleeve 3 has an open end at the edge of the precast concrete member. One end of reinforcing bar 2 in the direction oriented longitudinally of the precast concrete member is inserted into the splice sleeve, and projecting to a generally central point of the sleeve, the other end of the reinforcing bar 2 is projecting about one half of the length of the sleeve from the edge of the precast concrete member in which the sleeve is embeded.

Figure 2:
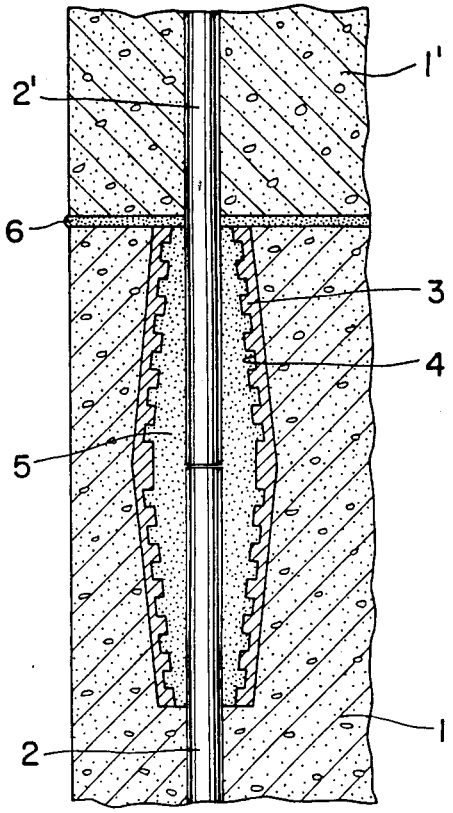
FIG. 2 is a cross-sectional view illustrating one application of the splice sleeve receiving an end of a reinforcing bar in the precast concrete member.

FIG. 2 illustrates the state of the combination of the adjoining precast concrete members 1 and 1', in which a projecting end of reinforcing bar 2' of the other precast concrete member 1' is inserted into the open end of the splice sleeve 3 embedded in the precast concrete member 1, and fluid grout 5 fills in the interior of the sleeve to join and set a pair of reinforcing bars 2 and 2' so that an adjoining pair of precast concrete members 1 and 1' are joined. As shown in the drawings, a pair of the reinforcing bars 2 and 2' are joined abutting each other at the generally central point of the sleeve. The interior walls of the splice sleeve 3 have a multiple grooves 4 in form of circle, and bedding mortar 6 is placed between adjoining faces of the precast concrete members.

Figure 3:
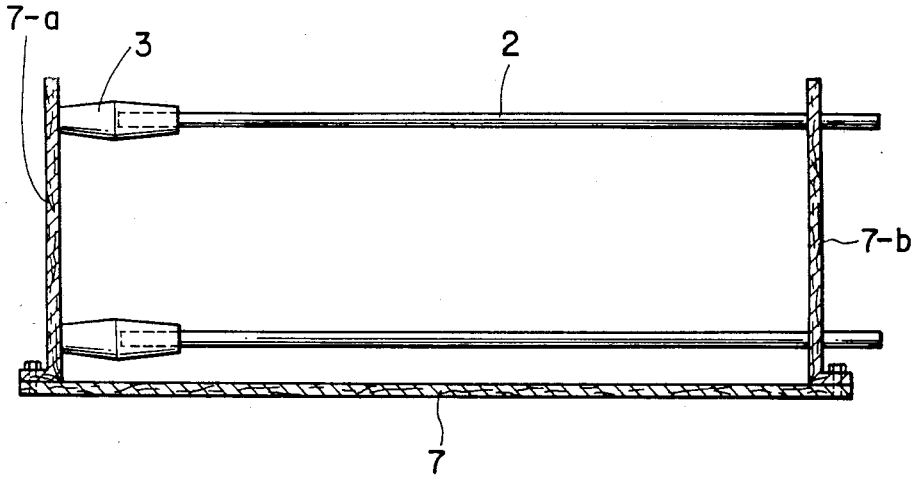
FIG. 3 is a cross-sectional view illustrating the arrangement in one application of the splice sleeves and reinforcing bars in the mold.

FIG. 3 illustrates an arrangement of the mold, splice sleeves to be embeded and reinforcing bars to be embeded for use in manufacturing a precast concrete member. The mold 7 is set horizontally to the direction of its elongation of a fundation bed so that the height of introducing concrete into the mold can be maintained as low as possible. Therefore, both of the reinforcing bars 2 and the splice sleeves 3 are set horizontally in the horizontal position. One end of the reinforcing bars are set through the vertically mold plate **7-*b* to be supported, and on the other hand, the other end of the reinforcing bars connected to the splice sleeve 3 are contacting to the vertical mold plate 7-*a*** so as not to be supported. The present invention shall resolve this shortcomings of the precast concrete member using the splice sleeve.

Figure 4:
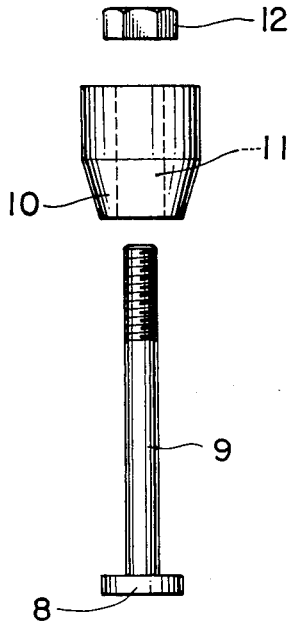
FIG. 4 is an elevational view of a tool for use in the application in accordance with the present invention.

The main tool for use in the present invention is as shown in FIG. 4, and comprises the following three major portions:

(1) an extending bar 9 having the pull-out preventing portion 8 at one end, (2) an elastic body 10 having mostly a column shape, preferably tapering toward the one end, and a through hole 11 at the central position therein into which the extending bar 9 is to be inserted, (3) drag holding means 12, holding an inserting rod 9 to the outside of the mold (nut form as an example in FIG. 4).

This tool is arranged so that the extending bar 9 is inserted into the through hole 11 of the elastic body 10, the pull-out preventing portion 8 of the bar is engaged to the face of the end toward which the elastic body is tapering, and the drag holding means 12 (for example nut means) is engaged at the other end of the bar 9 that is extending through the elastic body. When the drag holding means 12 is a nut, the extending bar 9 shall be threaded.

Figure 5:
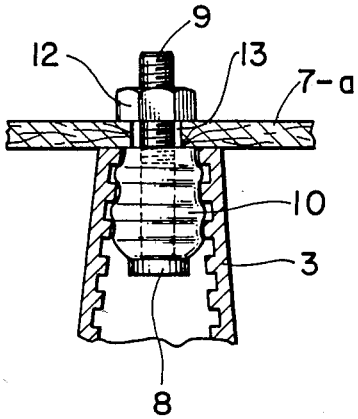
FIG. 5 is an enlarged cross-sectional detail, with portions taken away, illustrating one application of the tool and splice sleeve when the splice sleeve is fixed to the mold plate.

One application of the tool shown in FIG. 4 for setting of splice sleeve to the mold plate is shown in FIG. 5. The extending bar 9 is inserted into the elastic body 10 to the extent that the pull-out preventing portion 8 is engaged, and the so arranged elastic body is put in the splice sleeve 3 as shown in FIG. 5. Then the projecting end of the extending bar 9 projects from the through opening 13 provided in the mold plate **7-*a*, and the drag holding means 12 (for example a nut) is engaged to the projecting end of the bar 9. The drag holding means 12 will be operated (for example rotated in case of a nut) to drag the extending bar 9 toward the outside of the mold and then the elastic body 10 is shrunk between the interior face of the mold plate 7-*a* and the pull-out preventing portion 8, and deformed to expand generally traversely of the shrinkage so as to be pressed closely into contact to the interior surface of the splice sleeve. Then, the splice sleeve 3 is set to the adjoining mold plate 7-*a*. When the drag holding means 12 is unset (for example unscrewed in case of a nut) on the extending bar 9, the elastic body 10 is recovered and shaped back to be dissolved and loses contact of with the interior surface of the splice sleeve 3 and then the splice sleeve 3 is disjointed from the adjoining mold plate 7-*a***. Therefore, the tool of the present invention can be reused and recycled.

The drag holding means used in the present invention can be a variety of methods, and can be classified into two classes: bolt-nut system, and cam-rotation system. The following description explains the drag holding means for use in the present invention.

Figure 6:
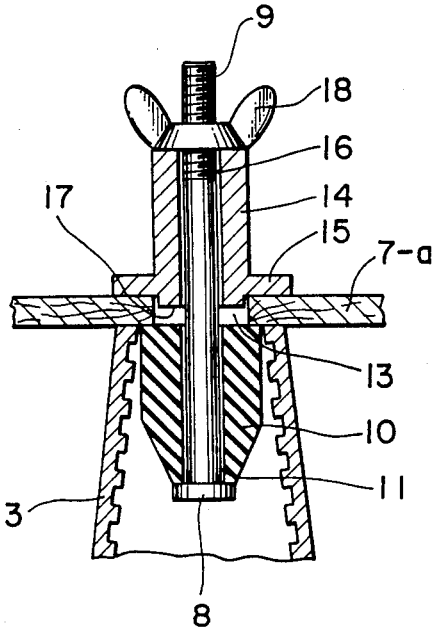
FIG. 6 is an enlarged cross-sectional view illustrating one application of a bolt-nut system.

FIG. 6 illustrates the drag holding means which comprises bolt and nut. A cylinder 14 having flange 15 is engaged to the exterior wall of the mold plate **7-*a*, in which the through opening 13 of the mold plate 7-*a* is aligned for the through hole 16 of the flanged cylinder 14. In order to facilitate this alignment, the underlying surface of the flange 15 preferably has a circle projection 17 to be closely engaged to the through opening 13 of the mold plate. The end of the extending bar 9 is first inserted through the elastic body 10, then introduced into the through opening 13 of the mold, then projected from the through hole 16 of the flanged cylindrical body 14 and is fastened by a nut 18. The nut 18 is fastened so as to drag the extending bar 9 toward the outside of the mold, and inversely loosened so as to unset the drag holding of the extending bar to the adjoining mold plate. A variety of known nuts can be used beside the butterfly shape nut as shown in FIG. 6**.

Figure 7A:
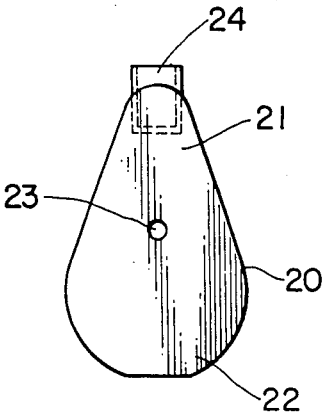
FIG. 7 (a) illustrates an elevational view and FIG. 7 (b) shows a side view of a cam for use in one application of the present invention.
Figure 7B:
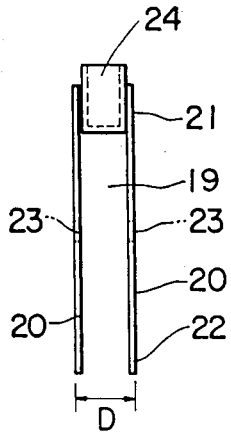
Figure 8:
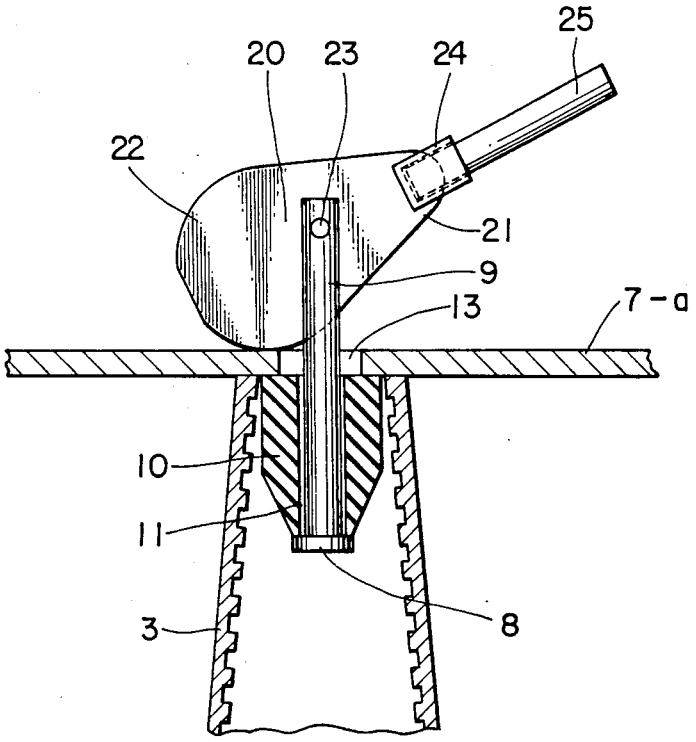
FIG. 8 is an enlarged cross-sectional view illustrating one application of the cam-rotation system in accordance with the present invention.

FIGS. 7 and 8 illustrate the cam-rotation system as an example for the drag holding means. FIG. 7 illustrates an example of a cam used for the cam-rotation system, wherein a cam 19 has the structure in which a shaft hole 23 is provided and two parallel cam plates 20 are provided in parallel, each other having the same shape, having a receiving cylinder 24 at the top of the cam of the double plate 20 to receive an operating rod 25. The cam 19 is engaged as shown in FIG. 8, rotationably to an appropriate bearing means of a shaft hole provided in the end portion of the extending bar 6 projecting from the exterior surface of the mold plate **7-*a*, which bar 6 is inserted through the elastic body 10 and the through opening 13 of the mold plate. The cam-rotation system shown in FIG. 8 is at the position of undrag, or just before drag holding position, wherein the cam 19 is obliquely in contact to the exterior surface of the mold plate 7-*a*. An operating (rotating) rod 25 is inserted into the receiving cylinder 24, and thereby the cam is rotated to the vertical position thereof. The bottom shape 22 of the cam plates 20 is such that the distance from the central shaft point to the peripheral point is gradually increasing, and therefore, when the cam is rotated, the extending bar 9 is drag pulled toward the outside of the mold plate 7-*a*. The bottom line of lower portion 22 of the cam plates 20 has a straight line to some extent (for example 1 cm) so that the cam 19 will be stably set at the vertical position. The extending bar 9 is dragged to the outside of the mold so as to be set stably on the mold plate, and then when the cam is rotated further to the horizontal position, the drag setting is removed. The shape of the cam plate should be such that the distance from the central shaft point to the peripheral points is gradually increasing by the rotation angle of the cam as hereinbefore described, and any shape of the cam plate can be used in the above provision. One example of the shape of the cam is as shown in FIGS. 7 and 8 in which the cam plate is tapering from the upper portion 21 toward the lower portion 22**, and the lower portion has mostly a circular arc in shape and further the bottom of the cam plate becomes a straight line. The cam-rotation system is advantageous in easy operation and one step operation in the drag engagement (the extending bar is drag set to the mold plate) and disengagement (the extending bar is unfastened from the mold plate) in comparison with the bolt-nut system, and further one can easily find whether the system is set or unfastened.

Figure 9:
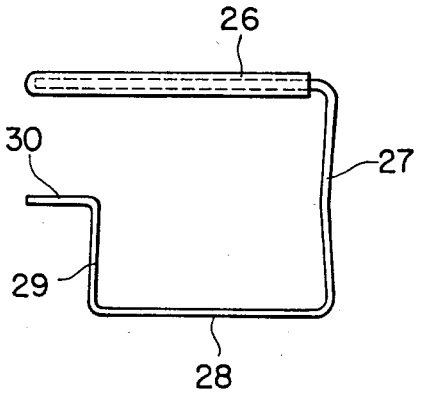
FIG. 9 is a plane view illustrating one embodiment of a shaft support member.

The cam 19 can be engaged rotationably to the extending bar 9 by a pin or the other mechanism to engage rotationably. The pin engagement has the disadvantage in that it is not easy to dismantle the cam from the extending bar. The shaft joint system usable in the present invention in which the cam can be easily removed from the engagement with the extending bar is shown in FIG. 9. This shaft support member as shown in FIG. 9 is constituted essentially from one elongated metal lever having a diameter of about 3 mm that has been bent at a certain position. This shaft support member essentially consists of a straight portion 26 which can be removally inserted into the shaft hole provided in the cam and the extending bar, the first bent portion 27 which has been bent almost at right angles from the straight portion, the second bent portion 28, the third bent portion 29 and the handle portion 30 in sequence of one member, all of those portions being provided in the same plane. All of the first bent portion to the third portion are bent to the same direction, but only the handle portion 30 is bent in the reverse direction to the other three portions. The length of the second bent portion 28 is almost the same as the width of the cam 19 (D as shown in FIG. 7). The straight portion 26 is inserted into the shaft hole and the third bent portion 29 is closely in contact to the cam plate 20 so as to rotate the shaft joint member, so that the first bent portion 27 and the third bent portion support the cam between them so as to engage the cam 19 to the shaft joint member. In order to secure and strengthen the engagement of the cam, the first bent portion 27 and the third bent portion 29 are preferably curved internally.

The shaft support member is rotated to remove the third bent portion 29 from the engagement on the cam plate 20 and then the shaft support member is dismantled or unengaged from the cam 19 so as to enable to pull out the straight portion 26 from the shaft hole. Therefore, when the shaft support member is used as shown in FIG. 9, the cam 19 can be engaged to the extending bar 9 and can be dismantled easily. The straight portion 26 can have a plastic tube as shown in the drawing so as to enlarge the diameter of the shaft so that the gap with the diameter of the shaft hole should be minimized. Further, the handle portion 30 may be modified in the similar way. The handle portion 30 may be eliminated, but preferably is convenient for the operator.

Figure 10:
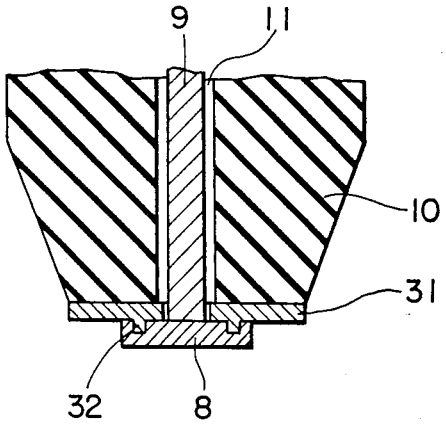
FIG. 10 is a cross-sectional view illustrating one example of a pull-out preventing portion.

The pull-out preventing portion 8 can be in various forms of for example, a disc fixed at the end of the extending bar, or a nut screwed to the end of the extending bar. The diameter of the pull-out preventing portion should be larger than the diameter of the end surface of the elastic body 10. When the diameter of the pull-out preventing portion is smaller than the diameter of the elastic body, only the part face of the elastic body contacting directly to the end surface of the pull-out preventing portion is pressed and shrunk and therefore, the uniform shrinkage can not be obtained. The size of the elastic body is dependent on the size of the splice sleeve to be used and should be varied. Therefore, the variety of the extending bar having the size of the pull-out preventing portion appropriate to the size of the elastic body has to be ready, but such preparation of the various extending bars is very complicated and troublesome. In order to solve this problem, a washer 31 as shown in FIG. 10 is used to be inserted between the pull-out preventing portion and the elastic body, and the washer appropriate to the size of the elastic body is selected depending on the size of the elastic body 10 so that the complicated preparation can be avoided. Further, the groove or uneven face 32 provided each on the pull-out preventing portion 8 and the washer 31 so as to be engaged each other is very convenient to prevent the extending bar 9 from rotating or co-rotating as the nut is turned in the case of bolt-nut system.

I claim:

1. In the manufacture of a precast concrete member having an outer edge, wherein elongated splice sleeves are embeded to one end of the precast concrete member in a direction oriented longitudinally of the precase concrete member, and the embeded sleeve has an open end at said edge of the precast concrete member, and, an inner end of a reinforcing bar is inserted into the splice sleeve in the direction oriented longitudinally of the precast concrete member, to a depth to about the central point of the elongated splice sleeve while the outer end of the reinforcing bar projects about one half of the length of the elongated splice sleeve from the edge of the precast concrete member in which the sleeve is embeded, a method of arranging an elongated splice sleeve with a hollow interior surface in a mold so as to receive a reinforcing bar so that said splice sleeve can be used in manufacturing a precast concrete member, said mold having an outer plate with an inner surface so that the splice sleeve open end abuts against said inner surface, said inner surface likewise having an aperture at the location of said splice sleeve open end, said method consisting of the steps of:

(a) using as the reinforcing bar, an extending bar having a pull-out preventing portion at the inner end and an engaging part at the outer end thereof;

(b) placing the elastic body at said inner end so that said elastic body extends longitudinally along a portion of said extending bar, said elastic body having a defined center with a hole, said extending bar passing through the hole in said defined center;

(c) inserting said extending bar into said splice sleeve in such a way that the elastic body is held in the splice sleeve by the pull-out preventing portion, but said engaging part as the outer end projects out of the mold; and, (d) providing a cam rotation arrangement drag means to the engaging part at the outer end of the extending bar which projects from the mold, the projecting end of the extending bar being disposed to be dragged outwards so that the elastic body is compressed between the pull-out preventing portion and the interior surface of the outer mold plate resulting in the elastic body being deformed to expand generally transversely to the extending bar against the interior surface of the splice sleeve and the mold, thereby fixing the splice sleeve to the mold.

* * * * *